US006503324B1

(12) United States Patent
Adair et al.

(10) Patent No.: US 6,503,324 B1
(45) Date of Patent: Jan. 7, 2003

(54) STUCCO TOWER AND METHOD

(75) Inventors: Robert D. Adair, Nunica, MI (US); Allen W. Ely, Grand Haven, MI (US); Qizhong Diao, Cupertino, CA (US)

(73) Assignee: Howmet Research Corporation, Whitehall, MI (US)

( * ) Notice: Subject to any disclaimer, the term of this patent is extended or adjusted under 35 U.S.C. 154(b) by 71 days.

(21) Appl. No.: 09/626,496

(22) Filed: Jul. 27, 2000

(51) Int. Cl.[7] ..... B05C 19/00; B05C 5/00

(52) U.S. Cl. ..... 118/309; 118/326; 118/DIG. 7; 118/312; 222/195

(58) Field of Search ..... 118/308, 309, 118/306, DIG. 5, DIG. 7, 326, 312; 427/182, 185; 222/195

(56) References Cited

U.S. PATENT DOCUMENTS

| | | | | |
|---|---|---|---|---|
| 2,217,247 A | * | 10/1940 | Burns | 118/312 |
| 3,811,250 A | | 5/1974 | Fowler, Jr. | 55/274 |
| 3,895,570 A | | 7/1975 | Eagleson, Jr. | 98/115 LH |
| 4,050,368 A | | 9/1977 | Eakes | 98/115 LH |
| 4,557,316 A | | 12/1985 | Takayanagi et al. | 164/517 |
| 4,576,613 A | | 3/1986 | Miline | 55/1 |
| 4,787,179 A | * | 11/1988 | Lewis | 51/426 |
| 4,998,581 A | | 3/1991 | Lane et al. | 164/517 |
| 5,113,749 A | | 5/1992 | Perbix | 454/193 |
| 5,295,902 A | | 3/1994 | Hock | 454/57 |
| 5,522,767 A | | 6/1996 | Bertsche et al. | 454/187 |
| 5,617,912 A | | 4/1997 | Ballewski et al. | 164/517 |
| 5,700,190 A | | 12/1997 | Johnson et al. | 454/57 |
| 5,711,705 A | | 1/1998 | Krainiak et al. | 454/57 |
| 5,738,819 A | | 4/1998 | Feagin | 264/635 |
| 5,810,656 A | | 9/1998 | Dowdell et al. | 454/56 |

* cited by examiner

*Primary Examiner*—Richard Crispino
*Assistant Examiner*—Yewebdar Tadesse

(57) ABSTRACT

Stucco tower and method for applying ceramic particulates to a ceramic slurry coated pattern involves positioning the ceramic slurry coated pattern in a chamber, discharging ceramic particulates downwardly onto the ceramic slurry coated pattern, and circulating air through air circulation plenums from a lower region of the chamber to an upper region thereof as the ceramic particulates are discharged. An air curtain is provided at an access opening to the chamber.

9 Claims, 8 Drawing Sheets

182b
176
180
178a
182a
178
189
192a
192
190
100
192d
192b
194
195
196
132o
132w
132
174
171
135
133
139a
F
139
137
138
152
154
200b
200
160
173
129a
170
173b
127
173a
175
129
173b
174a
172
131
S1
177

STUCCO TOWER AND METHOD

FIELD OF THE INVENTION

The present invention relates to an apparatus and method for applying ceramic stucco particulates to a ceramic slurry coated fugitive pattern used in manufacture of investment casting ceramic shell molds for casting metals and alloys.

BACKGROUND OF THE INVENTION

In casting superalloy gas turbine engine blades and vanes using conventional equiaxed and directional solidification techniques, ceramic shell molds with or without a ceramic core therein are filled with molten metal or alloy that is solidified in the mold. The ceramic shell mold is made by the well known lost-wax process where a fugitive (e.g. wax) pattern of the blade, vane or other article to be cast is repeatedly dipped in a ceramic slurry, drained of excess slurry and covered (stuccoed) with a layer of relatively coarse ceramic particulates, such as ceramic sand or stucco, to build up the shell mold wall to a desired wall thickness. The pattern then is selectively removed from the shell mold by thermal or chemical dewaxing techniques, and the green mold is fired to develop adequate mold strength for casting. U.S. Pat. Nos. 5,335,717 and 5,975,188 describe a typical lost wax process sequence to make ceramic investment casting shell molds.

The ceramic stucco particulates are applied to the wet ceramic slurry on the pattern by positioning the slurry coated pattern in an internal chamber of a so-called stucco tower. The stucco tower includes a ceramic stucco hopper at the top of the internal chamber for gravity discharging loose, dry ceramic stucco particulates from the hopper downwardly onto the slurry coated pattern positioned in the chamber through a front access opening thereof. As the ceramic stucco particulates fall by gravity, they push air downwardly in the chamber, creating vortices, turbulence and non-uniform air flow patterns in the chamber and out of the access opening, expelling fine ceramic stucco particulates and dust into the ambient atmosphere. As a result of such irregular air flow, stucco towers used in the past have suffered from problems of uneven distribution of stucco particulates within the tower, resulting in uneven shell mold wall thickness as well as discharge of fine stucco particulates and dust out of the access opening of the tower. Dust collectors have been provided on the stucco tower to collect the fine stucco particulates and dust expelled from the access opening.

An object of the present invention is to provide a stucco tower or other apparatus to provide improved distribution of particulates discharged in a chamber.

Another object of the present invention is to provide a stucco tower or other apparatus that reduces emission of particulates and dust therefrom.

SUMMARY OF THE INVENTION

An illustrative embodiment of the present invention provides stucco tower apparatus that includes an internal chamber in which a ceramic slurry coated pattern is positioned and one or more air circulating plenums positioned for circulating air from a lower region toward an upper region of the chamber as stucco particulates are discharged from a hopper above the chamber and fall by gravity onto the ceramic slurry coated pattern. The apparatus preferably includes an air curtain at an access opening to the chamber to reduce emission of stucco particles and dust, especially when the stucco particles are initially released from the hopper before air circulation through the chamber and the air circulation plenums is fully established.

A method embodiment of the present invention involves applying stucco particulates onto ceramic slurry coated pattern, wherein the ceramic slurry coated pattern is positioned in a chamber, stucco particulates are discharged downwardly in the chamber onto the ceramic slurry coated pattern and create a downward air flow in the chamber, and air is circulated from a lower region of the chamber to an upper region of the chamber as the stucco particulates are discharged. An air curtain is formed at an access opening to the chamber to reduce emission of stucco particles and dust.

Although the invention will be described in detail and illustrated with respect to stucco tower apparatus for applying ceramic stucco particles onto a ceramic slurry coated pattern, the invention is not so limited and can comprise apparatus of other types and uses for discharging particulates from an upper region to a lower region in a chamber.

The above objects and advantages of the present invention will become more readily apparent from the following detailed description taken with the following drawings.

DETAILED DESCRIPTION OF THE INVENTION

Figure 1:
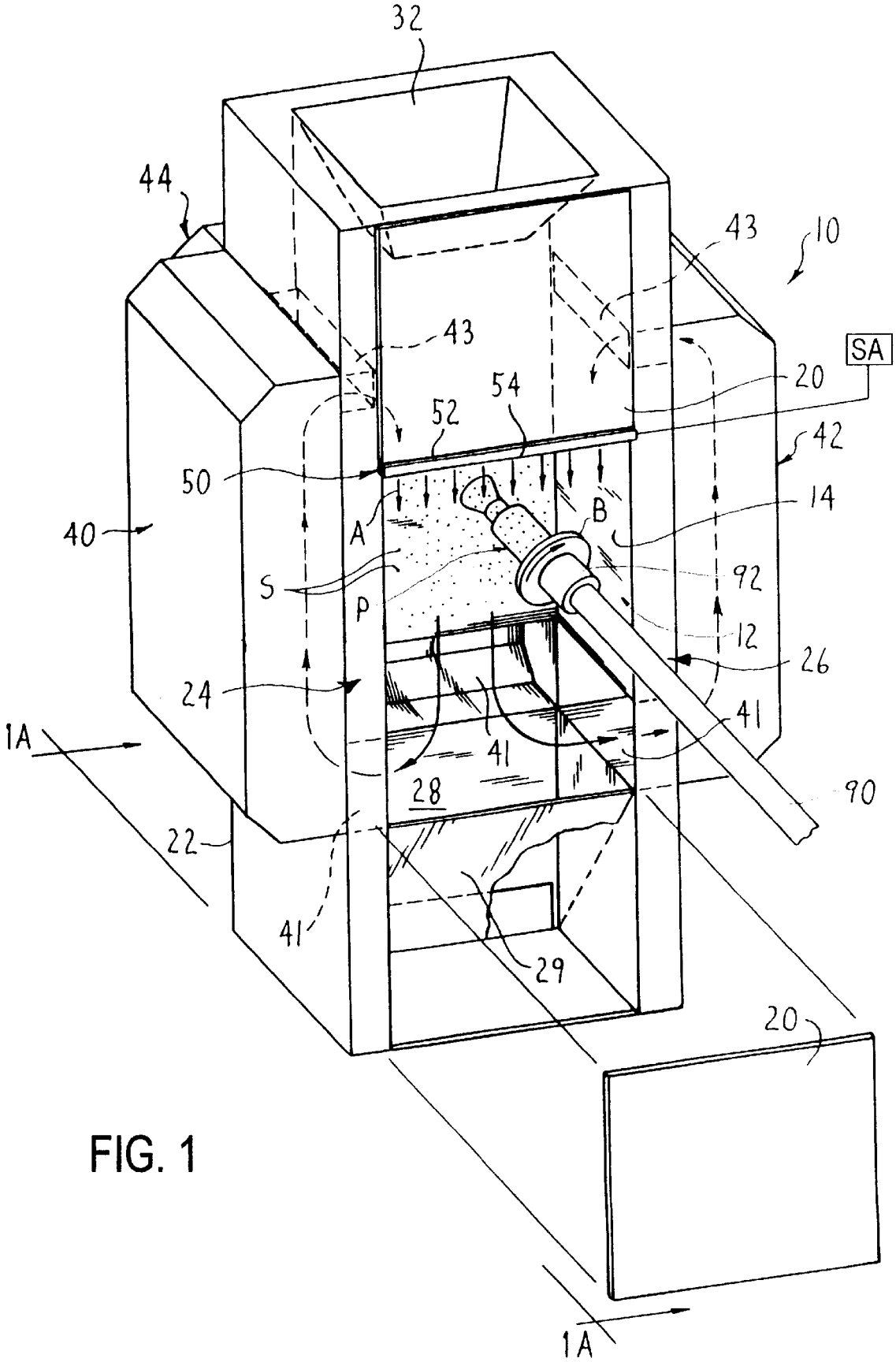
FIG. 1 is a schematic perspective view of a stucco tower in accordance with an embodiment of the invention where air circulation plenums are disposed on exterior side walls and a rear wall of the stucco tower. A front panel of the stucco tower apparatus is shown in exploded view to reveal a stucco collector.

Referring to FIG. 1, a stucco tower apparatus 10 in accordance with an embodiment of the invention is illustrated schematically for applying ceramic stucco particles to a wet ceramic slurry coated fugitive pattern P in practice of the well known "lost wax" process to buildup a refractory or ceramic investment shell mold on the pattern for use in casting molten metals and alloys. As discussed above, the lost wax process involves using a fugitive (e.g. wax) pattern of an article to be cast, repeatedly dipping the pattern in a ceramic slurry of fine ceramic powder or flour in a liquid, draining excess slurry from the pattern and then stuccoing the wet ceramic slurry layer with a layer of relatively coarse ceramic stucco particulates to build up the shell mold wall thickness to a desired value. The stucco particulates can comprise conventional ceramic sand particles, ceramic stucco particles and other ceramic particles used heretofore to stucco the wet slurry coated pattern in building up of the shell mold wall thickness. The pattern then is selectively removed from the shell mold by thermal or chemical dewaxing techniques, and the green mold is fired to develop adequate mold strength for casting. U.S. Pat. Nos. 5,335,717 and 5,975,188 describe a typical lost wax process sequence and materials to make ceramic investment casting shell molds.

The stucco tower apparatus 10 of FIG. 1 is used to apply a layer of the ceramic stucco particulates to the previously ceramic slurry coated pattern P in the practice of the lost wax process. The stucco tower apparatus includes an internal chamber 12 in which the wet ceramic slurry coated pattern P is positioned and rotated by a conventional robotic arm 90 to expose exterior surfaces of the slurry coated pattern P to ceramic stucco particles. The robotic arm 90 holds the base B of the slurry coated pattern P, or a suitable fixture (not shown) holding the base B, and extends through an access opening 14 communicated to the internal chamber 12 and uses the wrist 92 of the robot arm 90 to rotate the slurry coated pattern P in the chamber 12, the robot arm forming no part of the invention. Alternately, the slurry coated pattern P can be manually positioned and rotated in the chamber 12.

The chamber 12 is defined by a tower front wall 20 having access opening 14, a rear wall 22, and first and second side walls 24, 26 interconnecting the front wall and rear wall of the stucco tower apparatus. The walls 20, 22, 24, 26 may comprise a single wall panel or a pair of spaced apart wall panels such as illustrated for rear wall 22 comprising inner and outer wall panels 22*a*, 22*b*. A bottom opening 28 of chamber 12 is open to a stucco reclamation collector 29 therebelow to collect ceramic stucco particles that do not fall on and form a stucco layer on the slurry coated pattern P. The walls 20, 22, 24, 26 can comprise sheet metal, plastic, or other panels.

The top of the chamber 12 includes a stucco particulates hopper 32 that discharges the loose, dry ceramic stucco particulates for fall by gravity downwardly onto the wet ceramic slurry coated pattern P as it is rotated in the chamber 12. The hopper 32 is of the type described in more detail below with respect to FIGS. 3 and 4. The ceramic stucco particles S are discharged from the hopper 32 to rain down upon the rotating ceramic slurry coated pattern P as illustrated in FIG. 1 and stick onto the wet ceramic slurry layer on the pattern P to form a stucco layer thereon.

Figure 1A:
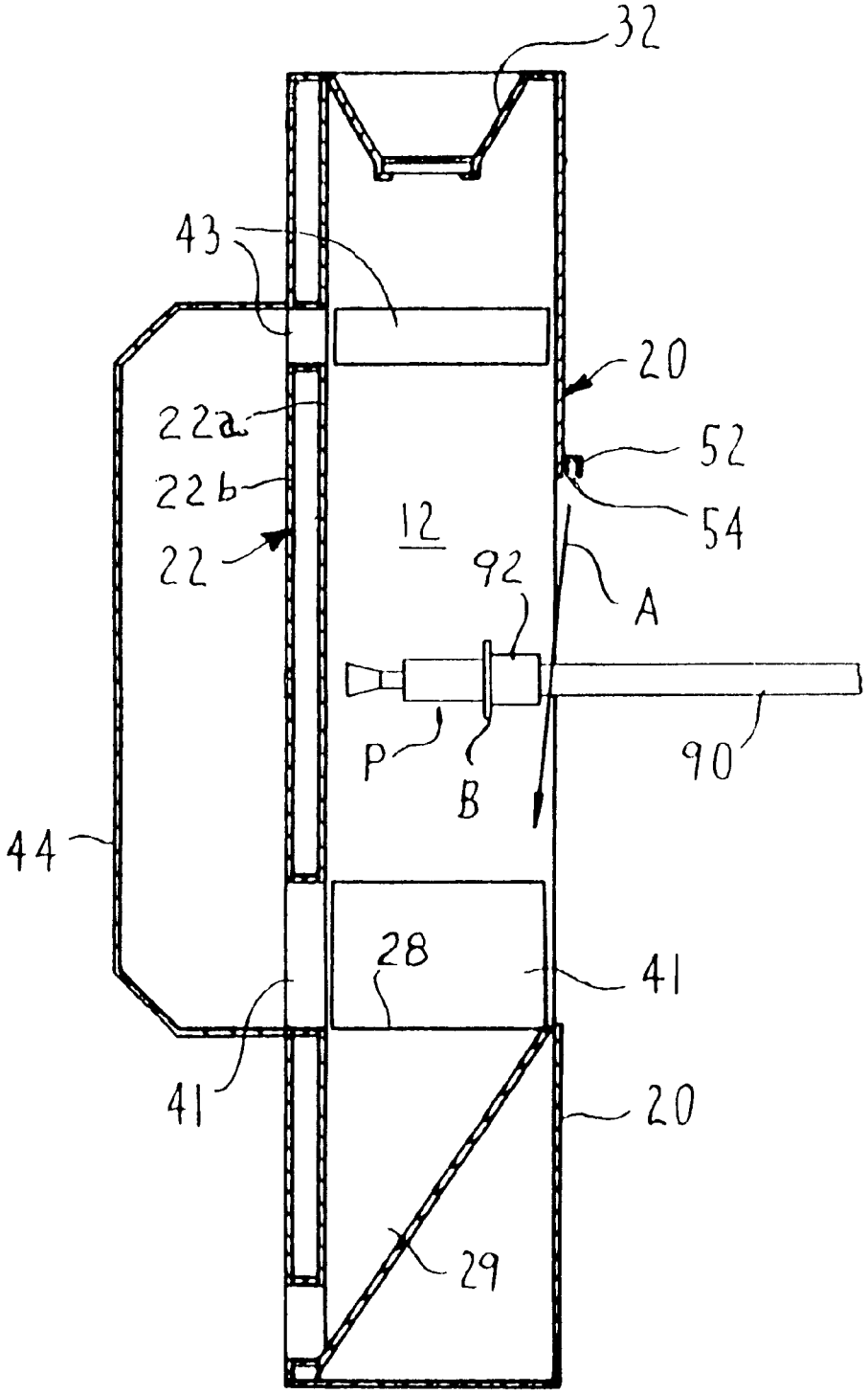
FIG. 1A is a sectional view of the stucco tower of FIG. 1 along line 1A—1A.

Pursuant to an embodiment of the invention, a first air circulation plenum 40 is provided adjacent and outboard (exterior) of the first side wall 24 and a second air circulation plenum 42 is provided adjacent and outboard (exterior) of the second side wall 26, FIG. 1. A third air circulation plenum 44 is provided adjacent and outboard (exterior) of the rear wall 22, FIG. 1A. The first air circulation plenum 40 is communicated by a lower opening 41 to the chamber 12 at the lower region thereof proximate bottom opening 28 and by a similar upper opening 43 at the upper region thereof below the hopper. The second air circulation plenum 42 is communicated by a lower opening 41 to the chamber 12 at the lower region thereof proximate the bottom opening 28 and by a similar upper opening 43 at the upper region thereof below the hopper. The third air circulation plenum 44 is communicated by a similar lower opening 41 to the plenum 12 at the lower region thereof proximate the bottom opening 28 and by a similar upper opening (not shown) at the upper region thereof below the hopper. As the ceramic stucco particles fall by gravity from the hopper 32 in the chamber 12, they create a relatively lower pressure at the upper region of the chamber 12 below the hopper 32 and a relatively higher pressure at the lower region of the chamber 12 proximate bottom opening 28 and push air through the air circulation plenums 40, 42, 44 for flow upwardly to the upper region of the chamber 12 below the hopper 32.

The air circulated back to the upper region of the chamber 12 is carried downwardly by the falling ceramic stucco particles S to establish air flow from the upper region to the lower region of the chamber 12 and from the lower opening 41 toward the upper opening 43 in the circulation plenums 40, 42, 44 as illustrated with the arrows. This air flow provides a more uniform air flow distribution from top to bottom in the chamber 12 to improve distribution of ceramic stucco particles falling therein and depositing on the ceramic slurry coated pattern P. The distribution of stucco particles on the slurry coated pattern and thus the uniformity of thickness of the shell mold wall thereby are improved.

The air circulation plenums 40, 42, 44 typically are formed as conventional sheet metal and/or plastic panel passages or ducts in the configurations shown for connection on the exterior of the stucco tower 10. The cross-sectional size and locations of the openings 41, 43 and the plenums 40, 42, 44 are chosen to provide uniform air flow downwardly from top to bottom in the chamber 12 with vortices and turbulence substantially reduced or eliminated to, in turn, provide a more uniform top-to-bottom stucco particulate flow in chamber 12.

Although air circulation plenums 40, 42, 44 are shown adjacent opposite side walls 24, 26 and rear wall 22, the invention is not a so limited as fewer or additional air circulation plenums may be used. For example only, air circulation plenums 40, 42 can be provided adjacent side walls 24, 26 while air circulation plenum 44 can be omitted. One or more air circulation plenums can be provided adjacent any one or more of the front and rear walls 20, 22 and side walls 24, 26.

The access opening 14 to the chamber 12 preferably includes an air curtain device 50 operably associated therewith. The air curtain device 50 comprises a compressed air conduit 52 that is disposed on the exterior of the front wall 20 and across the extent of the access opening 14 at its upper extent. The conduit 52 is connected to a source SA of filtered shop compressed air and includes a downwardly facing air discharge slot nozzle 54 to discharge a curtain of compressed air (designated by arrows A) downwardly toward the lower extent of the access opening 14 to confine stucco particles and dust in the chamber 12. The slot nozzle 54 may be oriented to discharge the air curtain at a slight angle inwardly toward the chamber 12 (e.g. 5 degrees relative to the vertical plane defined by the front wall 20). The compressed air can be supplied to the conduit 52 at 80 psi for example only to create the desired air curtain effect. Much of the stucco particles and dust that are pushed by air flow in chamber 12 toward the access opening 14 are deflected by the air curtain back toward the chamber 12 for entrainment in the air flow circulating in the chamber and the air circulation plenums 40, 42, 44. Dust collection ducts shown in FIGS. 3 and 4 can be provided to collect any fine stucco particles and dust that may escape from the access opening.

The air curtain device 50 can comprise a plurality of air discharge nozzles spaced laterally apart along the length of the conduit 52, rather than a single slot nozzle as illustrated in FIG 1. The air discharge nozzles will be arranged such that the air streams discharged therefrom collectively form an air curtain directed downwardly and preferably inwardly toward the chamber 12 to reduce emissions of ceramic stucco and dust from the access opening 14 during stuccoing of a wet ceramic slurry coated pattern in the chamber 12.

The air curtain device 50 is useful to prevent emission of stucco particles and dust from the chamber 12 when the ceramic stucco particulates are initially released from the hopper 32 before air circulation through the chamber 12 and air circulation plenums 40, 42, 44 is fully established.

The invention is not limited to provision of air circulation plenums 40, 42, 44 on the exterior of the stucco tower apparatus. For example, the invention can be practiced using air circulation passages formed interiorly within the stucco tower 10' as illustrated schematically in FIG. 2. In particular, interior side walls 24', 26' are disposed in the stucco tower 10' adjacent and inwardly of exterior side walls 60', 62' of the stucco tower. Air circulation passages or plenums 40', 42' are thereby formed between the inner side wall 24' and exterior tower side wall 60' and inner side wall 26' and exterior tower side wall 62'. The air circulation plenums 40', 42' communicate with the chamber 12' at a lower region proximate bottom opening 28' via lower opening 41' and at an upper region below hopper 32' via upper opening 43'. The air circulation plenums 40', 42' circulate air from the lower region of the chamber 12' to the upper region thereof beneath the hopper 32' as described for the embodiment of FIG. 1 when stucco particulates are discharged from the hopper. The air circulated back to the upper region of the chamber 12' is pushed downwardly by the falling ceramic stucco particles from the hopper 32' to establish air flow from the top to bottom in the chamber 12' and from bottom to top in the circulation plenums 40', 42' as illustrated with the arrows. An air curtain 50' is provided with a conduit 52' to supply compressed air to slot nozzle 54' to form an air curtain directed downwardly across the access opening 14' in front tower wall 20' as indicated by arrows A' as described in FIG. 1.

Figure 2:
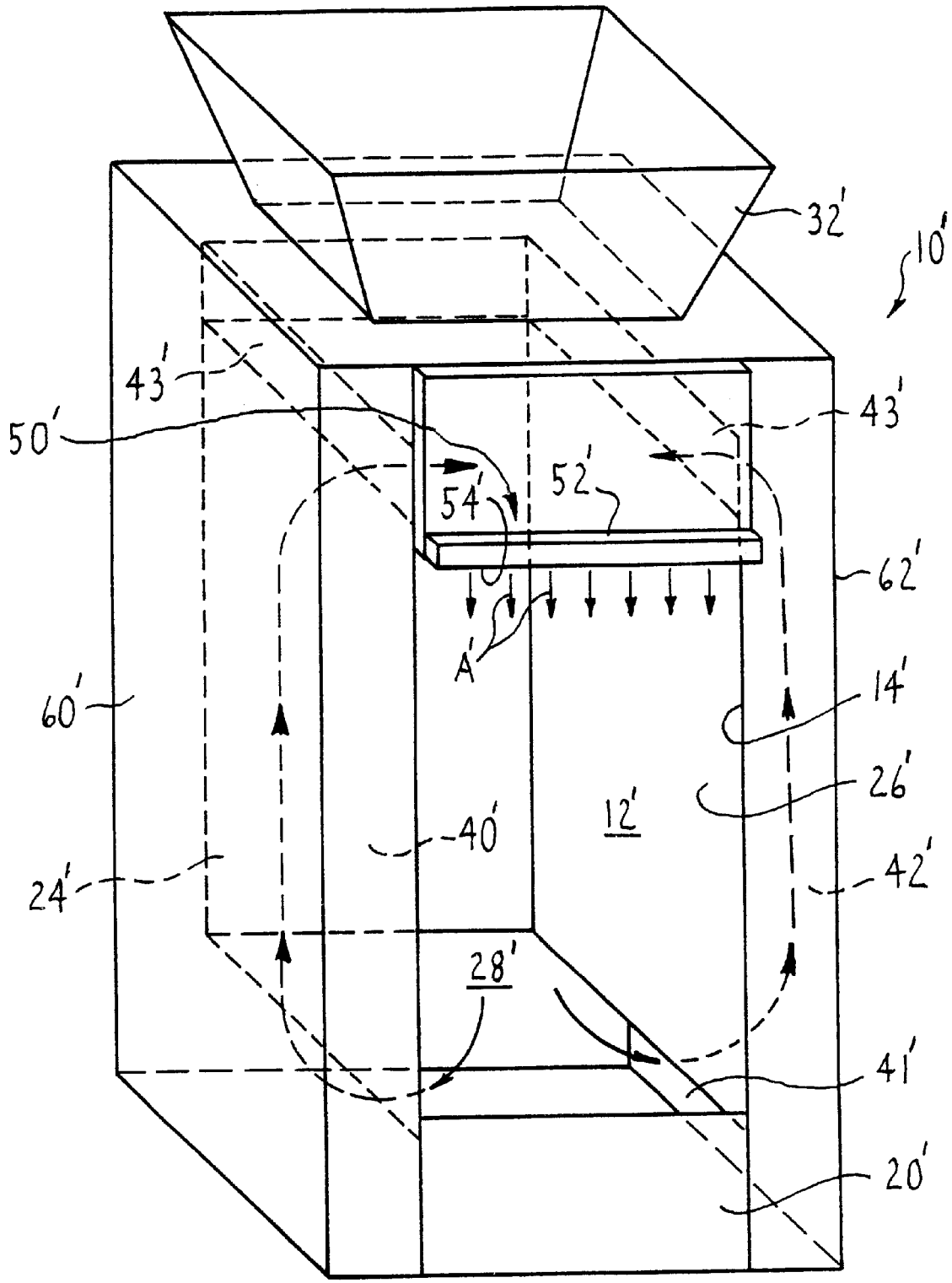
FIG. 2 is a schematic perspective view of a stucco tower of another embodiment of the invention where air circulation passages are disposed in the interior of the stucco tower.

In operation of the stucco towers of FIGS. 1 and 2 pursuant to the invention to apply ceramic stucco particulates to the wet ceramic slurry coated pattern P, the ceramic slurry coated pattern P is placed in the chamber 12 (12') via access opening 14 (14') and rotated by the robotic arm. The ceramic stucco particulates S then are released from the hopper 32 (32') to fall by gravity downwardly onto the ceramic slurry coated pattern to form a layer of ceramic stucco on the wet slurry layer. As ceramic stucco particulates are discharged from the hopper, air in the chamber 12 (12') is circulated by plenums 40, 42, 44 (40', 42') from the lower region of the chamber 12 (12') adjacent the bottom opening 28 (28') upwardly to the upper region of the chamber 12 (12') below the hopper 32 (32') as illustrated by the arrows. Concurrently, the air curtain generated across access opening 14 (14') by air curtain device 50 (50') reduces discharge of ceramic stucco particles and dust to the atmosphere outside the stucco tower. The slurry coated pattern is rotated in the chamber 12 (12') for a predetermined time to deposit a layer of stucco particles on the wet ceramic slurry layer previously applied to the pattern. The improved more uniform air flow distribution in chamber 12 (12') pursuant to the invention provides more uniform downward stucco flow to build up a more uniform shell mold wall thickness on the pattern.

Figure 3:
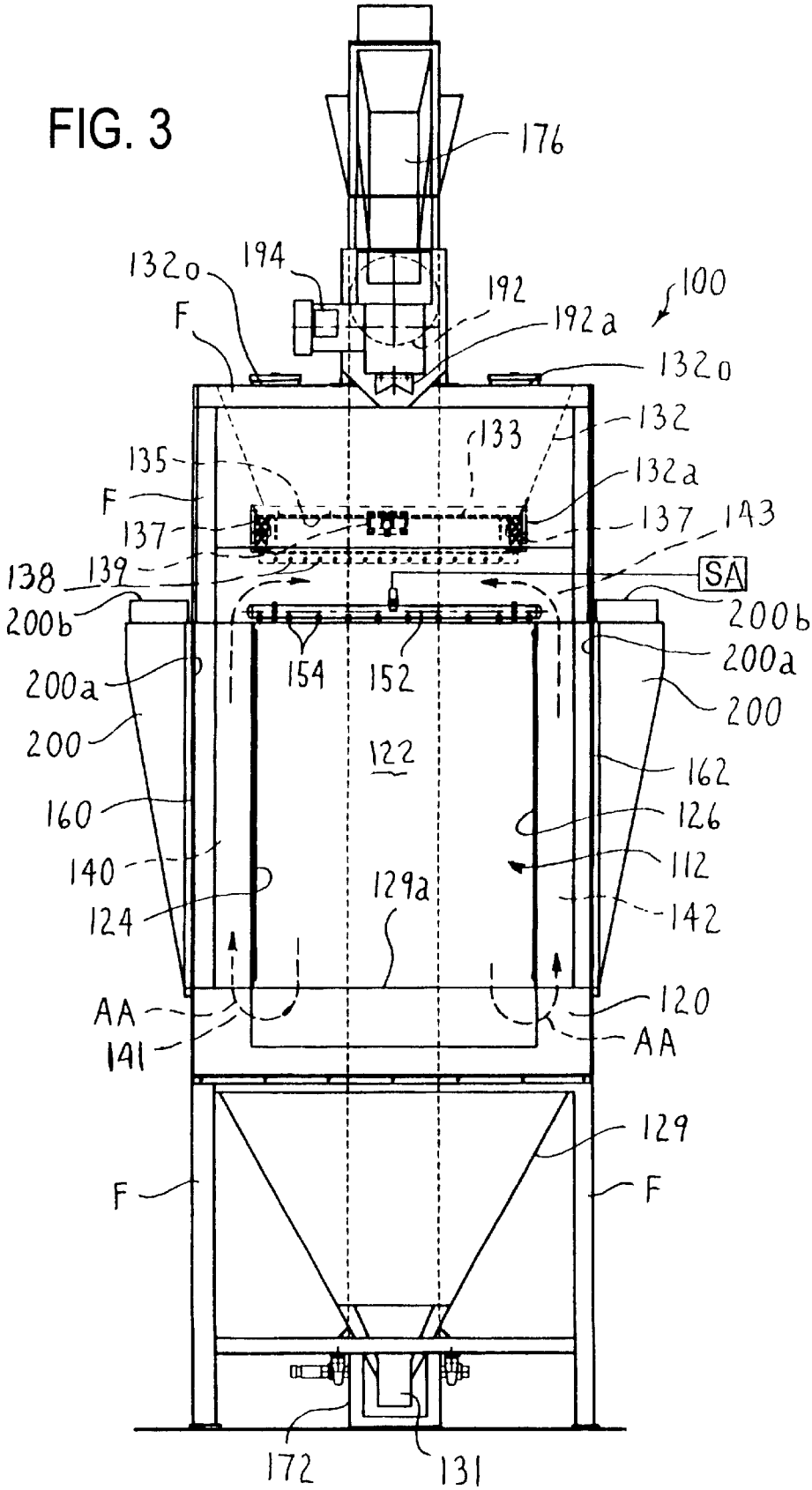
FIG. 3 is a front elevational view of a stucco tower in accordance with a working embodiment of the invention.
Figure 4:
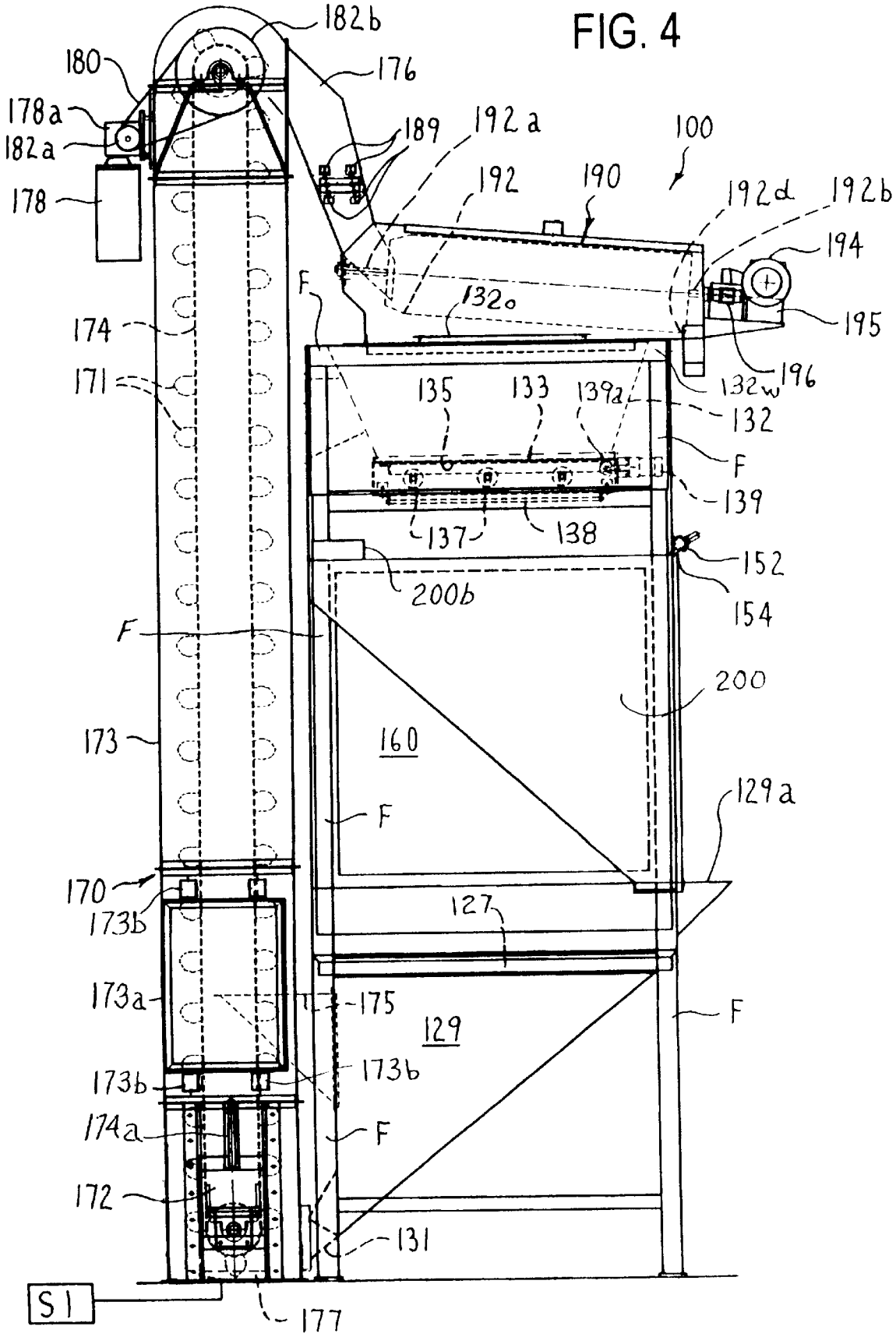
FIG. 4 is a side elevational view of the stucco tower of FIG. 3

Referring to FIGS. 3 and 4, stucco tower apparatus 100 is shown having internal chamber 112 defined by a front wall 120, rear wall 122 and first and second interior side walls 124, 126 and a bottom opening similar to opening 28' of FIG. 2. The side walls 124, 126 are spaced inwardly from exterior stucco tower side walls 160, 162 in a manner similar to FIG. 2 to define interior air circulation plenums 140, 142 that are each communicated to the lower region of the chamber 112 proximate bottom chamber opening by lower openings 141 and to the upper region of the chamber 112 below the hopper 132 by upper openings 143 to provide the air flow circulation pattern indicated by arrows AA in FIG. 3 pursuant to the invention. The chamber walls can comprise sheet metal panels mounted on structural frame members F or on the tower walls, although side walls 124, 160 and 126, 162 can comprise transparent plastic material, such as Plexiglass material to allow viewing of the chamber 112.

Figure 5:
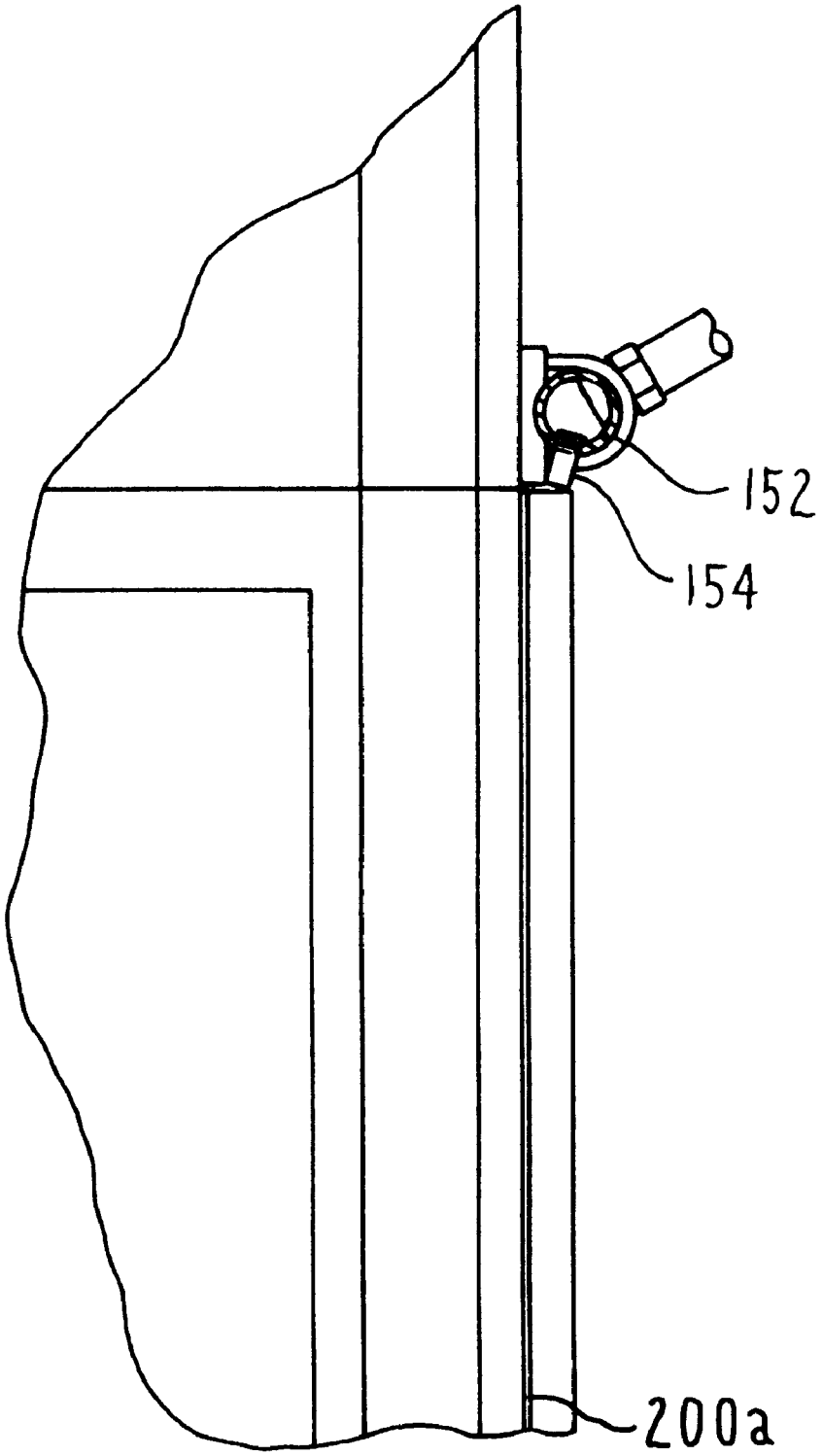
FIG. 5 is an enlarged view of an air curtain nozzle.

An air manifold conduit 152 connected to source SA of filtered shop compressed air at a pressure of, for example only, 80 psi is mounted on the front wall 120 and includes a plurality of air discharge nozzles 154 to discharge flat planar air streams that collectively form an air curtain directed downwardly across the access opening 114 in the front wall. The nozzles 154 are oriented on the conduit 152 to create an air curtain that is directed inwardly toward the chamber 112, FIG. 5. For example, the air curtain can be oriented inwardly at about 5 degrees relative to a vertical plane of the front wall 120. Suitable air nozzles are available as model MEG nozzles from Industrial Spray Products, PO Box 7900, Wheaton, Ill. 60189-7900.

Figure 6:
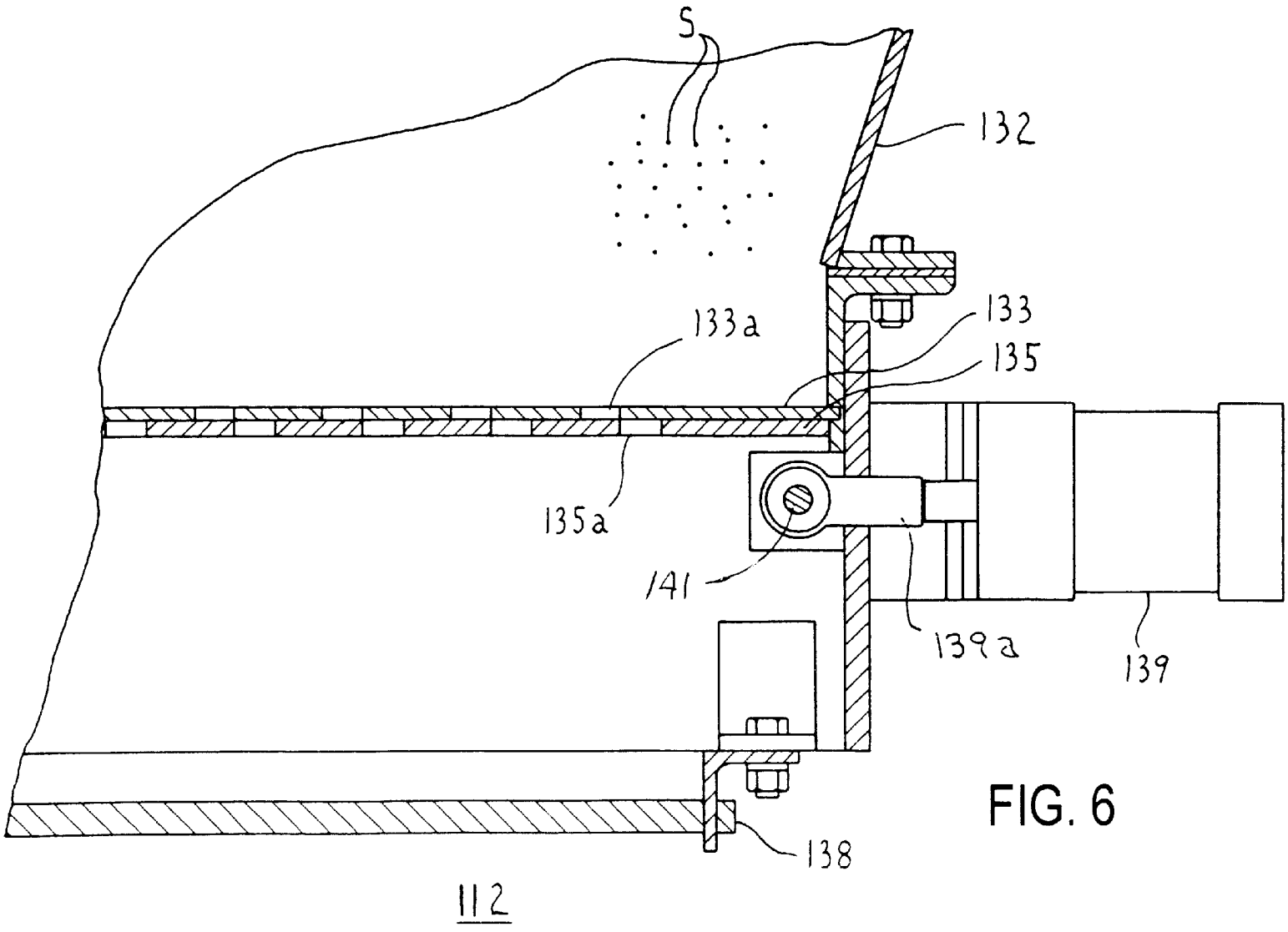
FIG. 6 is a partial sectional view of a hopper fixed plate and movable plate.

The stucco tower 100 includes a stucco hopper 132 at the top for discharging loose, dry ceramic stucco particles downwardly into the chamber 112. The hopper 132 includes a fixed plate 133 and movable plate 135 that slides on a plurality of pairs of wheels 137 mounted on the hopper sides 132*a*. As illustrated in FIG. 6, the fixed plate 133 includes a plurality of holes 133*a*, while the movable plate 135 includes a plurality of holes 135*a* that are aligned by movement with the holes 133*a* of the plate 133 to allow stucco particles to be discharged at a controlled rate from the hopper 132 into the chamber 112. Stucco particles are deflected by rods 138 aligned with the stucco stream, directly below stucco discharge holes 135*a*. The movable plate 135 is moved relative to the fixed plate 133 by a fluid (e.g. air) actuator 139 (e.g. an air or hydraulic cylinder) via its plunger 139*a* moving a cross-shaft 141 on the movable plate 135 to release the ceramic stucco particles from the hopper 132 to fall by gravity into the chamber 112 onto the ceramic slurry coated pattern therein (not shown in FIGS. 3 and 4). The ceramic stucco particles in the hopper 132 can comprise conventional ceramic stucco or sand particles having a particle size of 14 mesh to 120 mesh (US standard sieve) for purposes of illustration only. The hopper includes a top closure wall 132*w* with access covers 132*o* through which ceramic stucco particles can be introduced to the hopper.

Ceramic stucco particles that do not stick to the wet ceramic slurry on the wet ceramic slurry coated pattern fall into a stucco collector 129 at the bottom opening of the chamber 112. An apertured grate 127 optionally can be provided in the bottom opening of the chamber 112 above the collector 129 to catch large stucco particles and/or drips of ceramic slurry/stucco that might fall off of the pattern. The collector 129 includes walls sloped in a direction to direct the collected ceramic stucco particles to a funnel 131 that supplies the collected ceramic stucco particles to a lowermost particle collection chamber 172 of a pick-up elevator 170.

A wire mesh-covered trough 129*a* is provided at the lower extent of the access opening 114 exteriorly on the front wall 120 to catch any stucco particles falling off the pattern when it is removed from the chamber 112. The trough 129*a* communicates to the collector 129 so that the stucco particles that fall into the trough 129*a* then fall into the collector 129.

The pick-up elevator 170 includes a plurality of pick-up buckets 171 disposed on a conventional endless chain 174 disposed behind the stucco tower. The endless chain 174 moves the buckets 171 downwardly to scoop the ceramic stucco particles in collection chamber 172 into the buckets 171 and then upwardly to a discharge chute 176 where the buckets are moved to invert them in a manner to discharge the ceramic stucco particles into the chute 176. The endless chain 174 includes a tension adjustment screw 174*a*. The collection chamber 172 can include a porous stone or ceramic plate 177 disposed at the bottom of the chamber 172 and connected to a source S1 of compressed air at 40 psi for example only. The compressed air is supplied to the porous stone or ceramic plate 177 and is discharged into the collected ceramic stucco particles in the chamber 172 to fluidize them to facilitate pick-up by buckets 171. The endless chain 174 is driven by an electric motor 178 with gear reducer box 178*a* via a belt 180 between pulleys 182*a*, 182*b*. The elevator 170 includes an upstanding metal tunnel enclosure 173 that includes access panel 173*a* and panel toggle clamps 173*b* and is supported by brackets 175 connected to frame members F on the rear of the stucco tower.

Figure 7:
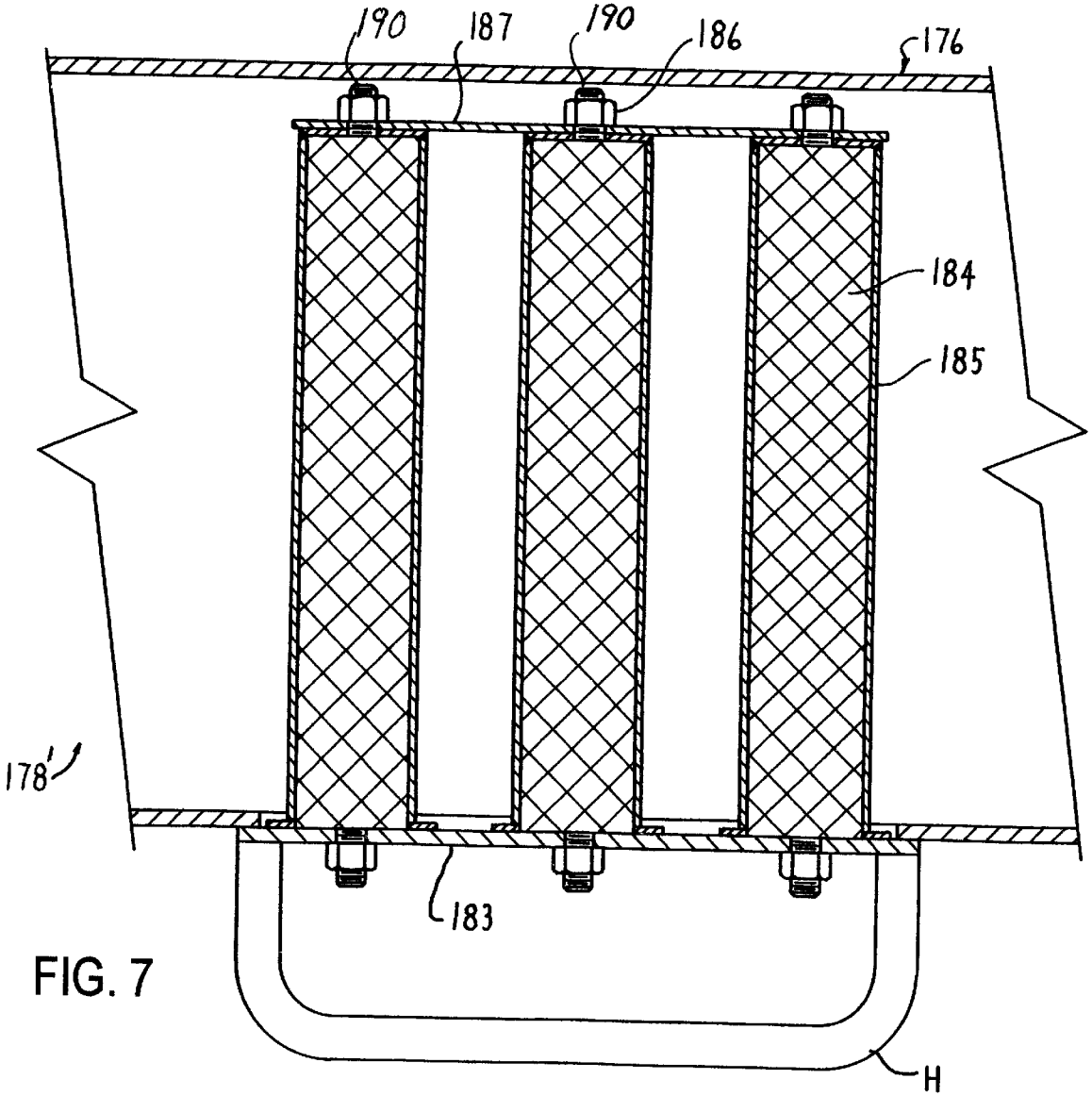
FIG. 7 is a partial sectional view of the magnet assembly.

The chute 176 includes a magnet assembly 178' FIG. 7, of permanent magnets 184 (e.g. cylindrical, rectangular, square and any other cross-section permanent magnets) disposed in the chute in the path of the ceramic stucco particles to remove any magnetic metallic particles or shavings that may be present in the ceramic stucco particles. The permanent magnets 184 are shown as cylindrical in shape. Each magnet 184 includes a removable tubular sleeve 185 made of non-magnetic material, such as aluminum, austenitic stainless steel and the like. The assembly 178' has a plate 183 that is clamped to the chute 176 by conventional toggle clamps 189 to position the permanent magnets 184 in the path of the ceramic stucco particles in the chute. The toggle clamps can be periodically released so that the magnet assembly can be removed from the chute 176 using handle H to clean off accumulated magnetic metallic particles and shavings. In particular, after the magnet assembly is removed from the chute, the sleeves 185 are removed from the magnets 184 by removing nuts 186 from threaded shafts 190 and removing plate 187. The metallic particles and shavings fall off the non-magnetic sleeves 185 when they are removed from the magnets 184. The sleeves then are reinstalled on the magnets 184 for return of the magnet assembly to inside the chute 176. The magnets 184 can be tubular with the shafts 190 extending therethrough or solid with shafts 190 connected at opposite ends of the magnets.

The ceramic stucco particles are supplied from the chute 176 to a rotating wire mesh screen drum 192 of a drum separator 190 located above the hopper 132. The drum 192 receives the stucco particles from the chute 176 and functions to allow stucco particles of the proper size to pass through the drum wire mesh screen to the hopper 132. The drum 192 is inclined upwardly such that ceramic stucco particles that are too large migrate down the drum 192 for discharge through a discharge end 192*d* to a collection container (not shown). The drum 192 is driven to rotate on drum shafts 192*a*, 192*b* by a conventional rotary electric motor 194 and gear reducer 195 connected to drum shaft 192*b* via a coupling 196.

A duct collection duct 200 is disposed on each side wall 160, 162 and functions to collect any fine stucco particles and dust that may escape from the access opening 114. To this end, each dust collection duct 200 includes an intake slot 200*a* disposed along a respective vertical side of the access opening 114 such that the intake slot 200*a* of one collection duct 200 faces the intake slot 200*a* of the opposing collection duct 200. The collection ducts 200 include connection ports 200*b* that are connected to a dust collection blower (not shown) that generates a suction in the ducts 200 to suck or draw any fine stucco particles and dust escaping from the access opening 114 through the intake slots 200*a* and into the ducts 200 where the particles and dust are filtered out of the air stream in conventional manner and forming no part of the invention. Although the invention has been described in detail and illustrated with respect to stucco tower apparatus for applying ceramic stucco particles onto a ceramic slurry coated pattern, the invention is not so limited and can comprise apparatus of other types and uses for discharging particulates downwardly from an upper region to a lower region in a plenum.

Although the invention has been described with respect to certain specific embodiments thereof, those skilled in the art will appreciate that the invention is not limited to these embodiments and that various changes, additions, omissions, and the like can be made therein without departing from the scope of the invention as set forth in the appended claims.

We claim:

1. Apparatus, comprising:

a chamber, means for discharging particulates downwardly from an upper region to a lower region of said chamber, and an air circulation plenum communicated by a lower opening to said lower region of said chamber and by an upper opening to said upper region of said chamber to circulate air from said lower region to said upper region as said particulates are discharged downwardly in said chamber.

2. The apparatus of claim 1 wherein said chamber is defined by a front wall, a rear wall, and first and second side walls interconnecting said front wall and rear wall.

3. The apparatus of claim 2 including a first air circulation plenum adjacent said first side wall and a second air circulation plenum adjacent said second side wall.

4. The apparatus of claim 1 wherein said upper opening is disposed below said means for discharging particulates.

5. The apparatus of claim 2 including an access opening to said chamber and an air curtain disposed at said access opening.

6. The apparatus of claim 5 wherein said air curtain includes a plurality of air discharge nozzles proximate an upper extent of said access opening for discharging air downwardly.

7. The apparatus of claim 6 wherein said nozzles are angled toward a wall having said access opening therein.

8. The apparatus of claim 1 including a collection chamber for the ceramic particulates and means for fluidizing the particulates in the collection chamber.

9. The apparatus of claim 4 wherein said means for discharging particulates comprises a hopper.

* * * * *